US009211452B2

(12) United States Patent
Bennett et al.

(10) Patent No.: US 9,211,452 B2
(45) **Date of Patent: *Dec. 15, 2015**

(54) METAL WOOD CLUB

(71) Applicant: Acushnet Company, Fairhaven, MA (US)

(72) Inventors: Thomas Orrin Bennett, Carlsbad, CA (US); Michael Scott Burnett, Carlsbad, CA (US); Daniel S. Callinan, Carlsbad, CA (US); Christopher D. Harvell, Escondido, CA (US); Jeffrey W. Meyer, Fallbrook, CA (US); Stephen S. Murphy, Carlsbad, CA (US)

(73) Assignee: Acushnet Company, Fairhaven, MA (US)

( * ) Notice: Subject to any disclaimer, the term of this patent is extended or adjusted under 35 U.S.C. 154(b) by 20 days.

This patent is subject to a terminal disclaimer.

(21) Appl. No.: 14/133,260

(22) Filed: Dec. 18, 2013

(65) Prior Publication Data

US 2014/0106896 A1 Apr. 17, 2014

Related U.S. Application Data

(60) Division of application No. 13/738,862, filed on Jan. 10, 2013, now abandoned, which is a division of application No. 13/206,191, filed on Aug. 9, 2011, now abandoned, which is a division of application No.

(Continued)

(51) Int. Cl.
*A63B 53/04* (2015.01)
*A63B 53/06* (2015.01)

(52) U.S. Cl.
CPC ..... *A63B 53/06* (2013.01); *A63B 53/0466* (2013.01); *A63B 2053/045* (2013.01);

(Continued)

(58) Field of Classification Search
CPC ..... A63B 53/0466; A63B 53/06; A63B 2053/0408; A63B 2053/0412; A63B 2053/0416; A63B 2053/045; A63B 2053/0458; A63B 2053/0491; A63B 2225/01; A63B 2053/0433; A63B 53/04
USPC ..... 473/328, 345–346, 337–338
See application file for complete search history.

(56) References Cited

U.S. PATENT DOCUMENTS 1,091,231 A 3/1914 Millar
1,096,359 A 5/1914 Dwight (Continued)

FOREIGN PATENT DOCUMENTS

CN 1459321 A 12/2003
CN 1810328 A 8/2006

(Continued)

OTHER PUBLICATIONS

English language full machine translation of JP 2000-70418.

(Continued)

*Primary Examiner* — Stephen Blau
(74) *Attorney, Agent, or Firm* — Randy K. Chang

(57) ABSTRACT

A golf club head is provided with a body that has an address position with a zero degree bounce portion on the sole and a center sole position with a multi-relief surface of the sole having a negative bounce portion. The negative bounce portion may comprise a negative 0.5 to a negative 4.0 degree surface. In one embodiment, the multi-relief surface may comprise the negative bounce portion and a cutaway portion extending to the back of the sole, which may have a depth of about 0.05 to 0.5 inch from a regular sole surface. In another embodiment, the golf club head includes a weight system to adjust the center of gravity. In one embodiment, the weight system is a tube having a weight at one end that may be inserted into the golf club head to move the center of gravity at least forward and backward within 6 mm and up and down within 6 mm. Preferably, the tube is angled downward toward the face by at least 3 degrees.

14 Claims, 16 Drawing Sheets

Related U.S. Application Data

12/911,052, filed on Oct. 25, 2010, now Pat. No. 7,997,998, which is a continuation of application No. 11/560,903, filed on Nov. 17, 2006, now Pat. No. 7,824,277, which is a continuation-in-part of application No. 29/245,472, filed on Dec. 23, 2005, now Pat. No. Des. 532,474.

(52) U.S. Cl.

CPC . *A63B2053/0408* (2013.01); *A63B 2053/0412* (2013.01); *A63B 2053/0416* (2013.01); *A63B 2053/0433* (2013.01); *A63B 2053/0458* (2013.01); *A63B 2053/0491* (2013.01); *A63B 2225/01* (2013.01)

(56) References Cited

U.S. PATENT DOCUMENTS 1,133,129 A 3/1915 Govan
1,167,387 A * 1/1916 Daniel ..... 473/337
1,396,470 A 11/1921 Taylor
1,436,579 A 11/1922 Dayton
1,467,435 A 9/1923 Kinnear
1,575,364 A 3/1926 Hodgkins
1,840,924 A 1/1932 Tucker
2,041,676 A 5/1936 Gallagher
2,705,147 A * 3/1955 Winter ..... 473/245
2,750,194 A 6/1956 Clark
3,064,980 A 11/1962 Steiner
3,606,327 A 9/1971 Gorman
3,652,094 A 3/1972 Glover
3,794,328 A 2/1974 Gordon
3,897,066 A 7/1975 Belmont
3,979,123 A 9/1976 Belmont
4,195,842 A 4/1980 Coleman
4,512,583 A 4/1985 Leveque de Vilmorin
D285,473 S 9/1986 Flood
4,732,389 A 3/1988 Kobayashi
4,754,977 A 7/1988 Sahm
4,811,949 A 3/1989 Kobayashi
4,869,507 A 9/1989 Sahm
4,944,515 A 7/1990 Shearer
5,028,049 A 7/1991 McKeighen
5,042,806 A 8/1991 Helmstetter
5,176,383 A 1/1993 Duclos
D344,118 S 2/1994 Lin
5,447,309 A 9/1995 Vincent
5,484,155 A * 1/1996 Yamawaki et al. ..... 473/242
5,547,188 A * 8/1996 Dumontier et al. ..... 473/287
5,547,427 A 8/1996 Rigal et al.
5,570,886 A 11/1996 Rigal et al.
5,573,469 A 11/1996 Dekura
5,586,948 A 12/1996 Mick
5,797,807 A 8/1998 Moore
5,803,830 A 9/1998 Austin et al.
5,888,148 A 3/1999 Allen
5,935,020 A 8/1999 Stites et al.
5,980,394 A * 11/1999 Domas ..... 473/327
5,989,134 A 11/1999 Antonious
6,074,310 A 6/2000 Ota
6,120,389 A * 9/2000 Kruse ..... 473/328
6,123,627 A 9/2000 Antonious
D433,073 S * 10/2000 Sodano ..... D21/752
6,458,044 B1 10/2002 Vincent et al.
6,471,601 B1 10/2002 McCabe et al.
D465,251 S * 11/2002 Wood et al. ..... D21/752
6,524,194 B2 2/2003 McCabe
D482,421 S 11/2003 Kessler
6,645,085 B2 11/2003 McCabe et al.
6,648,772 B2 11/2003 Vincent et al.
6,648,773 B1 11/2003 Evans
6,811,496 B2 11/2004 Wahl et al.
D501,235 S * 1/2005 Imamoto ..... D21/752
D514,184 S 1/2006 Kawami
D519,178 S * 4/2006 Shimazaki ..... D21/752
D520,090 S * 5/2006 Imamoto ..... D21/752
D527,434 S 8/2006 Foster et al.
D529,111 S * 9/2006 Cleveland et al. ..... D21/752
7,121,956 B2 10/2006 Lo
7,140,977 B2 11/2006 Atkins
7,166,038 B2 * 1/2007 Williams et al. ..... 473/329
7,255,653 B2 * 8/2007 Saso ..... 473/345
7,294,064 B2 * 11/2007 Tsurumaki et al. ..... 473/329
D614,713 S * 4/2010 Oldknow ..... D21/759
7,824,277 B2 11/2010 Bennett et al.
2002/0111229 A1 * 8/2002 Helmstetter et al. ..... 473/344
2002/0137576 A1 * 9/2002 Dammen ..... 473/336
2002/0160851 A1 10/2002 Liao
2003/0045371 A1 * 3/2003 Wood et al. ..... 473/328
2004/0192463 A1 * 9/2004 Tsurumaki et al. ..... 473/329
2005/0009622 A1 1/2005 Antonious
2005/0096151 A1 5/2005 Hou et al.
2006/0052181 A1 * 3/2006 Serrano et al. ..... 473/345
2007/0149315 A1 6/2007 Bennett et al.
2007/0155533 A1 7/2007 Solheim et al.

FOREIGN PATENT DOCUMENTS

JP 2000-70418 A 3/2000
JP 2001-112895 A 4/2001

OTHER PUBLICATIONS

English language full machine translation of JP 2001-112895.

* cited by examiner

METAL WOOD CLUB

RELATED APPLICATIONS

This application is a divisional of U.S. patent application Ser. No. 13/738,862, filed on Jan. 10, 2013, which is a divisional of U.S. patent application Ser. No. 13/206,191, filed Aug. 9, 2011, which is a divisional of U.S. patent application Ser. No. 12/911,052, filed Oct. 25, 2010, now U.S. Pat. No. 7,997,998, which is a continuation of U.S. patent application Ser. No. 11/560,903, filed on Nov. 17, 2006, now U.S. Pat. No. 7,824,277, which is a continuation-in-part of U.S. application No. 29/245,472, now U.S. Pat. D532,474, filed on Dec. 23, 2005, the disclosures of which are incorporated by reference herein in their entirety.

FIELD OF THE INVENTION

The present invention relates to an improved golf club. More particularly, the present invention relates to a wood-type golf club head with improved physical attributes.

BACKGROUND

Golf club heads come in many different forms and makes, such as wood- or metal-type (including drivers and fairway woods), iron-type (including wedge-type club heads), utility- or specialty-type, and putter-type. Each of these styles has a prescribed function and make-up. The present invention relates primarily to hollow golf club heads, such as wood-type and utility-type (generally referred to herein as wood-type golf clubs).

Wood-type or metal-type golf club heads generally include a front or striking face, a crown, a sole and an arcuate skirt including a heel, a toe and a back. The crown and skirt are sometimes referred to as a shell. The front face interfaces with and strikes the golf ball. A plurality of grooves, sometimes referred to as "score lines," may be provided on the face to assist in imparting spin to the ball and for decorative purposes. The crown is generally configured to have a particular look to the golfer and to provide structural rigidity for the striking face. The sole of the golf club is particularly important to the golf shot because it contacts and interacts with the ground during the swing.

The complexities of golf club design are well known. The specifications for each component of the club (i.e., the club head, shaft, grip, and subcomponents thereof) directly impact the performance of the club. Thus, by varying the design specifications, a golf club can be tailored to have specific performance characteristics.

The design and manufacture of wood-type club heads requires careful attention to club head construction. Among the many factors that must be considered are material selection, material treatment, structural integrity and overall geometrical design. Exemplary geometrical design considerations include loft, lie, face angle, horizontal face bulge, vertical face roll, face size, center of gravity, sole curvature, and overall head weight. The interior design of the club head may be tailored to achieve particular characteristics, such as by including hosel or shaft attachment means, perimeter weighting on the face or body of the club head, and fillers within hollow club heads. Club heads are typically formed from stainless steel, aluminum, or titanium and are cast, stamped, as by forming sheet metal with pressure, forged, or formed by a combination of any two or more of these processes.

The club heads may be formed from multiple pieces that are welded or otherwise joined together to form a hollow head, as is often the case of club heads designed with inserts, such as soleplates or crown plates. The multi-piece constructions facilitate access to the cavity formed within the club head, thereby permitting the attachment of various other components to the head such as internal weights and the club shaft. The cavity may remain empty, or may be partially or completely filled, such as with foam. An adhesive may be injected into the club head to provide the correct swing weight and to collect and retain any debris that may be in the club head. In addition, due to difficulties in manufacturing one-piece club heads to high dimensional tolerances, the use of multi-piece constructions allows the manufacture of a club head to a tight set of standards.

It is known to make wood-type golf clubs out of metallic materials. These clubs were originally manufactured primarily by casting durable metals such as stainless steel, aluminum, beryllium copper, etc. into a unitary structure comprising a metal body, face and hosel. As technology progressed, it became more desirable to increase the performance of the face of the club, usually by using a titanium material.

Players generally seek a metal wood driver and golf ball combination that delivers maximum distance and landing accuracy. The distance a ball travels after impact is dictated by the magnitude and direction of the ball's translational velocity and the ball's rotational velocity or spin. Environmental conditions, including atmospheric pressure, humidity, temperature, and wind speed, further influence the ball's flight. However, these environmental effects are beyond the control of the golf equipment manufacturer. Golf ball landing accuracy is driven by a number of factors as well. Some of these factors are attributed to club head design, such as center of gravity and club face flexibility.

Known methods to enhance the weight distribution of wood-type club heads to help reduce the club from being open upon contact with the ball usually include the addition of weights to the body casting itself or strategically adding a weight element at some point in the club. Many efforts have been made to incorporate weight elements into the wood-type club head. These weight elements are usually placed at specific locations, which will have a positive influence on the flight of the ball or to overcome a particular golfer's shortcomings.

The sole of the golf club is particularly important to the golf shot because it contacts and interacts with the ground during the golf shot. There are many sole configurations to optimize the performance of the club. Typically, the sole of the club is slightly curved such that when the club head is placed on the ground, the leading edge is located above the ground. The curvature toward the front of the club generally provides bounce. Bounce assists in preventing the club from digging into the ground and substantially slowing club head speed. The curvature toward the trailing edge generally prevents the club head from getting caught on the ground during the back swing.

The present invention is directed to an improved golf club sole for wood-type golf clubs that increases the club's playability. Additionally, the present invention is directed to an improved weighting system for wood-type golf clubs that increases the club's playability.

SUMMARY OF THE INVENTION

The present invention relates to a golf club head comprising a body having a face, a sole, a crown and a skirt joining the face, sole and crown, the body having a heel end and a toe end, wherein the body has an address position with a zero degree bounce portion on the sole and a center sole position with a negative bounce portion on the sole. In one embodiment the negative bounce portion may comprise a negative 0.5 to a negative 4.0 degree surface, or more preferably a least a negative 2.0 degree surface.

The negative bounce portion may further comprise a cutaway portion extending to the back of the sole. The cutaway portion may have a depth of about 0.05 to 0.5 inch. The negative bounce portion may have a generally triangular or parabolic shape. The negative bounce portion may be located on the sole a distance of about 0.1 to 1.0 inch from the face of the club head, or more preferably a distance of about 0.35 to 0.65 inches from the face of the club head. The negative bounce portion may have a constant angle or an angle that varies toward the back of the sole.

In another embodiment a golf club according to the invention may have a club head with a body having a face, a sole, a crown and a skirt joining the face, sole and crown, the body having a heel end and a toe end, wherein when the toe end is up at least 5 degrees a first measurement of the face measures square, and at a centered position a second measurement of the face measures different from the first measurement. The face may measure at least two degrees more open at the second measurement or at least two degrees open at the second measurement. The centered position may comprise a negative bounce portion. The negative bounce portion may further comprise a cutaway portion extending to the back of the sole. The second measurement of the centered position may occur at club head impact with a golf ball. At the second measurement the shaft angle may measure about 55 to 60 degrees from a ground surface. The first measurement may occur at address position and the shaft angle may measure about 55 to 45 degrees from a ground surface.

In another embodiment, the present invention relates to a golf club head comprising a body having a face, a sole, a crown and a skirt joining the face, sole and crown, the body having a center of gravity. The body has a coordinate system with an x-axis located horizontal to the club face, a y-axis located vertical to the club face, and a z-axis located through the club face, and a weight system for the club head, wherein the center of gravity is adjustable at least along the z-axis and the y-axis. The center of gravity is movable within a 6 mm distance along the z-axis, and more preferably within a 4 mm distance along the z-axis. The center of gravity is movable within a 6 mm distance along the y-axis, and more preferably within a 2 mm distance along the y-axis. The center of gravity is movable within a 2 mm distance along the x-axis, and more preferably within a 0.5 mm distance along the x-axis.

The weight system may comprise at least one tube for placement within the club head and within a plane formed by the y axis and z axis to adjust the center of gravity. In one embodiment, multiple inserts varying in weight may be placed within the tube at various positions to move the center of gravity to the desired location. Alternatively, a weight is provided at one end of the tube, and the tube is placed within the club head to move the center of gravity to the desired location for a desired ball flight. The tube may be angled downward toward the face of the club head by at least 3 degrees from the z-axis, more preferably about 3 to about 7 degrees.

The tube may be flippable, such that the weight is moveable to the other end of the club head to move the center of gravity for a desired different ball flight. When the weight is located at a back of the club head, a shot hit off the club head has increased backspin and a higher launch angle resulting in a softer landing. When the weight is located at a front of the club head a shot hit off the club head has less backspin and a lower trajectory resulting in a shallower landing for increased distance.

In one embodiment, the weight comprises tungsten. The weight may have a mass from about 10 grams to about 35 grams. The tube and weight combine to have a mass of about 20 to about 40 grams. The tube may comprise aluminum. The tube may include a fastener on at least one end to assist in fastening the tube in the club head. The tube may be fastened to the inside of the club head adjacent the face. In an alternative embodiment, the tube may be fastened to the outside of the club head substantially flush with the club head body.

In an alternative embodiment, the weight system may further comprise three cavities provided in the club head and three separate inserts provided for placement within the cavities, wherein the inserts may have a different mass and may be placed in different cavities to move the center of gravity within the coordinate system.

In yet another embodiment, the weight system may further comprise a pipe for placement within the club head to adjust the center of gravity. At least one weight is slidably provided on the pipe to move the center of gravity to the desired location. The slidable weight may be moved along the shaft to the desired location manually from outside of the club head. The pipe may be angled downward toward the face of the club head by at least 3 degrees from the z-axis, and more preferably about 3 to about 7 degrees.

BRIEF DESCRIPTION OF THE DRAWINGS

Preferred features of the present invention are disclosed in the accompanying drawings, wherein similar reference characters denote similar elements throughout the several views, and wherein.

DETAILED DESCRIPTION OF THE PREFERRED EMBODIMENT

Figure 1:
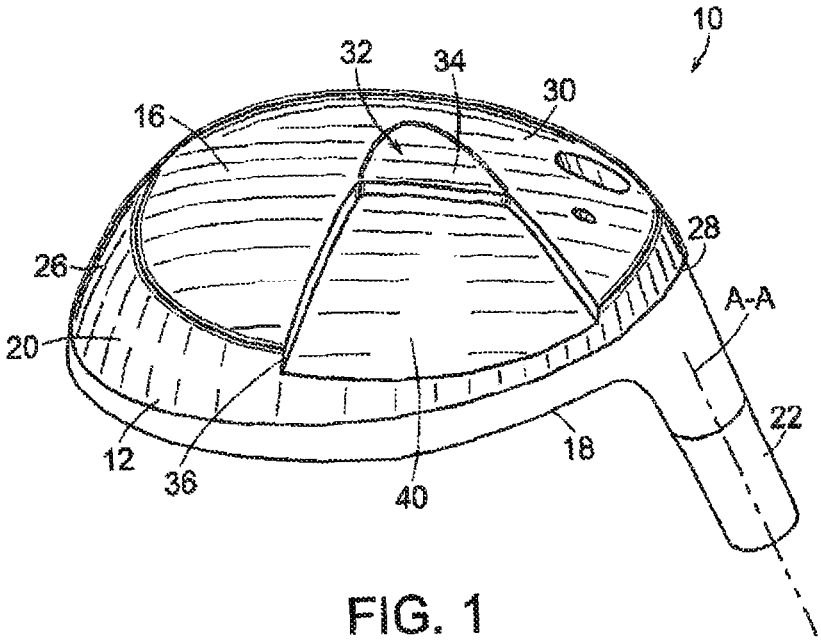
FIG. 1 is a perspective view of an embodiment of a club head of the present invention.

FIG. 1 shows a golf club head 10 of the present invention. Club head 10 includes a body 12 having a strike face 14, a sole 16, a crown 18, a skirt 20 and a hosel 22. The body defines a hollow interior volume 24 (See FIGS. 4B-4D). Foam or other material may partially or completely fill the interior volume. Weights may be included within the interior volume. The face may be provided with grooves or score lines of varying design. The club head has a toe 26 and a heel 28.

A golf club shaft (not shown) is attached at hosel 22 and is disposed along a shaft axis A-A. The hosel 22 may extend to the bottom of the club head 10, may terminate at a location between the sole and crown portions 16 and 18 of the head 10, or the hosel 22 may terminate flush with the crown portion 26.

It is recommended that the inner volume 24 have a volume greater than 125 cubic centimeters, and more preferably greater than 175 cubic centimeters. Preferably, the mass of the inventive club head 10 is greater than 150 grams, but less than 220 grams; although the club head may have any suitable weight. The body 12 may be formed of sheets welded together or cast, preferably from steel, aluminum or titanium or any other suitable material or combination thereof.

The strike face 14 may be made by milling, casting, forging or stamping and forming. The face 14 may be made of any suitable material, including titanium, titanium alloy, carbon steel, stainless steel, beryllium copper, and other metals or composites. The face 14 may have any suitable thickness, and may be uniform or varied. As will be appreciated, the face 14 may be connected to the body 12 by any suitable means, including bonding and welding. Alternatively, the body 12 and face 14 may be cast simultaneously forming a homogeneous shell and eliminating the need to bond or otherwise permanently secure a separate face 14 to the body 12. Alternatively, the sole 16 or crown 18 may be formed separately and fitted to the remainder of the body 12 as is known to those of skill in the art.

Figure 2:
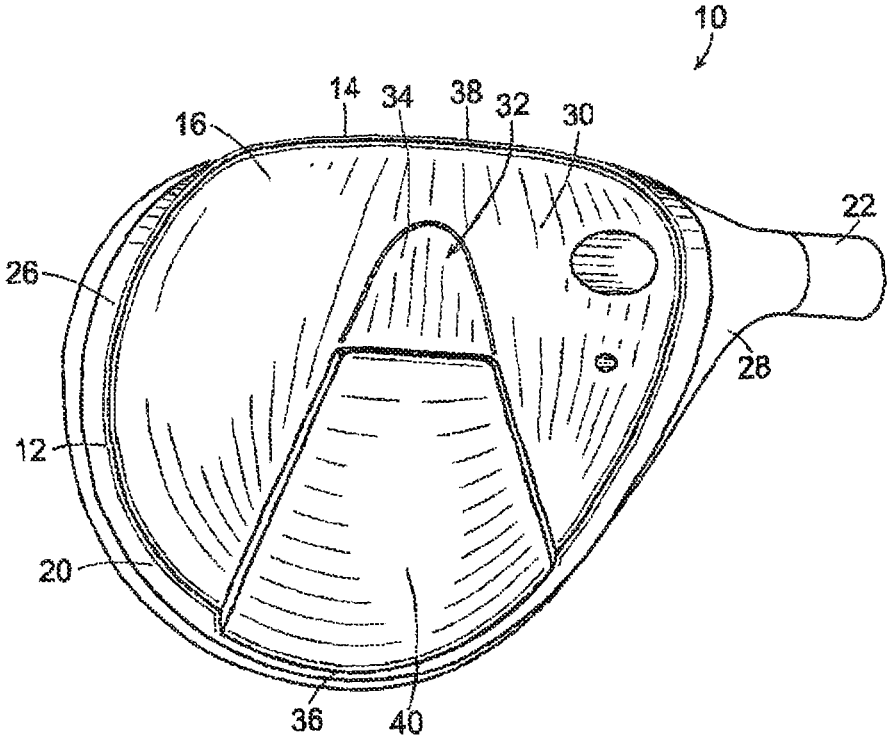
FIG. 2 is bottom plan view of an embodiment of a club head of FIG. 1.

The sole 16 preferably has a complex shape that accomplishes two objectives. The first objective is to provide a surface for the club head 10 to sit on in the address position that squares the face 14 to the target. The second objective is to provide a sole shape that gives more clearance to the ground at impact than would be available in a club head with a conventional sole. In order to achieve the first objective, an address portion or zero degree bounce portion 30 is provided. This portion is a sufficient area on the sole 16 on which the club head 10 may rest when placed at the address position by a golfer. The zero degree bounce portion 30 may be a flat portion provided on the sole 16. The zero degree bounce portion 30 may be directly centered behind the face 16 or, as illustrated, may be provided more toward the heel 28. As illustrated in FIGS. 1 and 2, the sole 16 has a zero degree bounce portion 30, such that at address the club head 10 rests at this point and the face 14 is square to the target. The zero degree bounce portion 30 enables the club head 10 to sit just as a conventional club head without a sole having a complex shape. Thus, the complex sole of the inventive club head 10 does not adversely affect the way the club head sits at address.

Figure 3A:
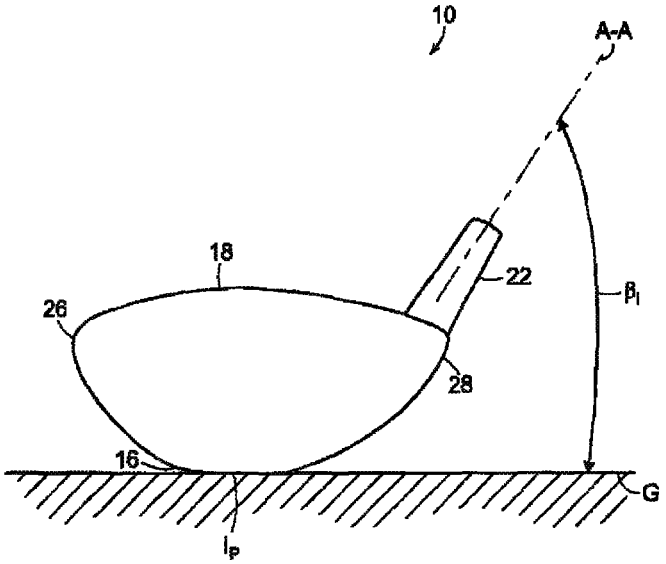
FIG. 3A is a front plan view of an embodiment of a club head according to FIG. 1 at impact with a golf ball.
Figure 3B:
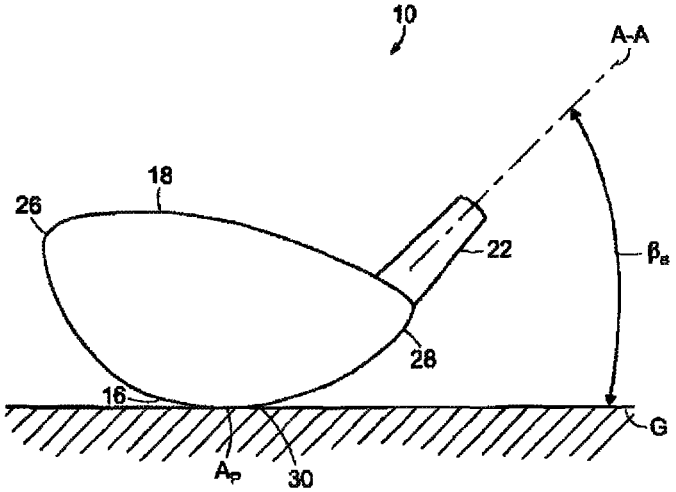
FIG. 3B is a front plan view of an embodiment of a club head according to FIG. 1 at address.

In order to achieve the second objective, a portion of the sole 16 is relieved to give it a multi-relief surface 32 with a negative bounce. Preferably, a negative bounce portion 34 is provided on the sole 16 in a center portion that is spaced from the face 14 of the club head 10. Thus, the club head 10 has two areas of bounce. As illustrated in FIGS. 3A and 3B, the impact position $I_p$ of the club head 10 is different than an address position $A_p$ because the dynamics of the golf swing cause the shaft to flex at impact thereby moving the position of the club head 10. FIG. 3B illustrates the club head at address where the face is square to the target, the shaft axis A-A creates an angle with the ground G called the shaft angle $\beta_a$. As illustrated in FIG. 3A, during impact, the club head is rotated a few degrees upright, and the shaft axis A-A creates a different angle with the ground G called shaft angle $\beta_i$.

It will be appreciated that in one embodiment the toe 26 may be up at least 5 degrees at a first measurement, for example when the club head 10 sits at address, such that the face 14 measures square. At a second measurement, for example during impact with a golf ball, taken at a centered position the face 14 measures differently than the first measurement. For example, the face 14 may measure at least two degrees more open at the second measurement than the first measurement, or at least two degrees open at the second measurement than the first measurement. The centered position may comprise the negative bounce portion 34, which may be a substantially flat surface. When the first measurement occurs at the address position, the shaft angle $\beta_a$ preferably measures about 55 to 45 degrees. When the second measurement occurs at impact of the club head 10 with a golf ball, the shaft angle $\beta_i$ measures about 55 degrees to 60 degrees.

As illustrated in FIGS. 1 and 2, the sole 16 features a multi-relief surface 32 to provide greater ground clearance at the trailing edge 36 of the sole 16 to minimize turf resistance. With this construction, the ground/sole contact point remains forward toward the leading edge 38 of the strike face 14. Maintaining a forward ground/sole contact point improves directional control and ball flight, by reducing the potential of the club head 10 to bounce or skip onto the ball. This is particularly true of players that play the ball forward in their stance, or who sweep the ball from the turf with a shallow angle of attack. Preferably, the multi-relief surface 32 sole features the negative bounce portion 32 and a cutaway portion 40.

Figure 4B:
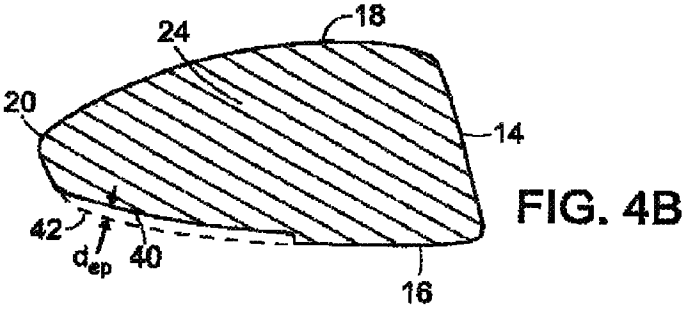
FIG. 4B is a cross-sectional view of the club head of FIG. 4 taken along line 3B-3B in FIG. 4.
Figure 4C:
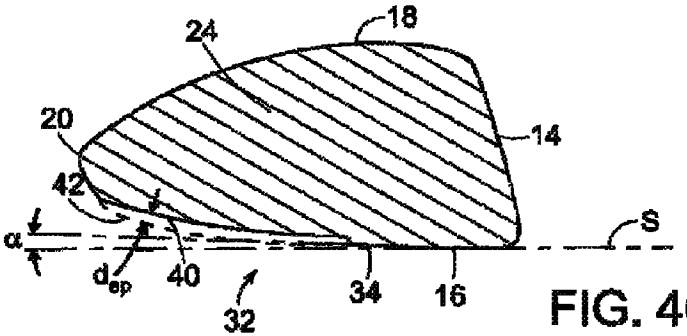
FIG. 4C is a cross-sectional view of the club head of FIG. 4 taken along line 4C-4C in FIG. 4.
Figure 4D:
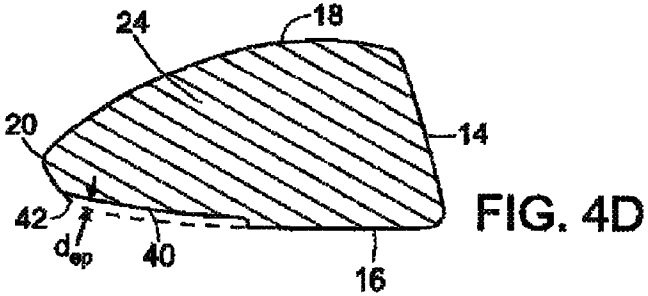
FIG. 4D is a cross-sectional view of the club head of FIG. 4 taken along line 4D-4D in FIG. 4.
Figure 4A:
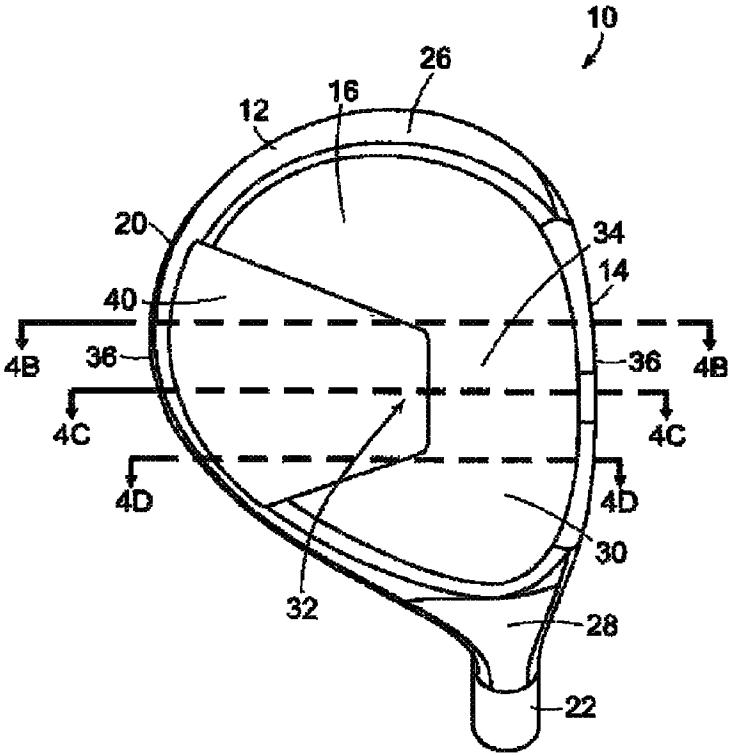
FIG. 4A is bottom plan view of an embodiment of a club head of FIG. 1.

The negative bounce portion 34 may have any desired overall shape; preferably the negative bounce portion 34 has a triangular shape as shown in FIGS. 1 and 2. FIGS. 4A-4D illustrates the negative bounce portion 34 and cutaway portion 40 in the sole 16. Cross-sectional views illustrated in FIGS. 4B and 4D show cutaway portion 40 in comparison with the regular surface 42 of a conventional club head sole. FIG. 4B illustrates the cross-sectional view of the center section of the club head 10 with the negative bounce portion 34 and cutaway portion 40 in comparison with the regular surface of a conventional club head sole 42.

Figure 5:
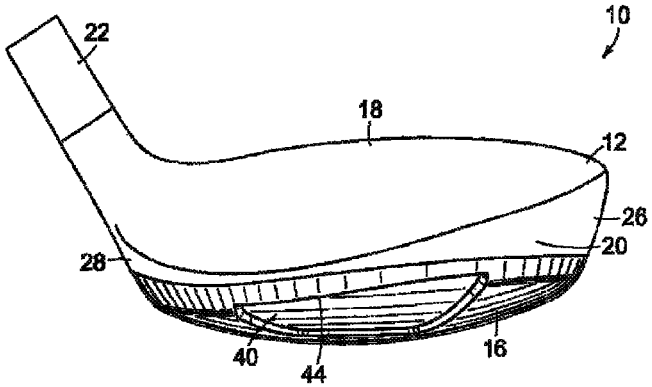
FIG. 5 is a back view of the club head of FIG. 1.
Figure 6:
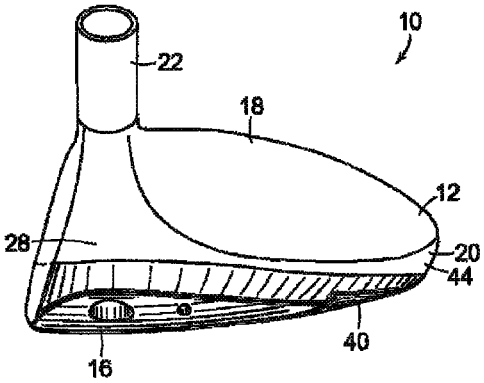
FIG. 6 is a heel side view of the club head of FIG. 1.

The cutaway portion 40 extends from the negative bounce portion 34 to the trailing edge 36 of to the club head 10. As illustrated in FIGS. 4B-D, the cutaway portion 40 continues and may gradually increase the negative surface from the plane S running along the bottom of the sole. Preferably, the cutaway portion 40 has a depth $d_{cp}$ of about 0.05 to 0.5 inch from the regular surface of a conventional club head sole 42; this depth may or may not be constant. FIGS. 5 and 6 illustrate the back 44 and heel 28 of the club head. The full extent of the cutaway portion 40 can be envisioned.

Figure 7B:
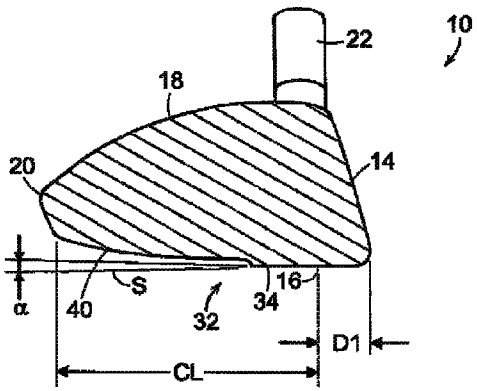
FIG. 7B is a cross sectional view of the club head of FIG. 7A taken along line 7B-7B.
Figure 7A:
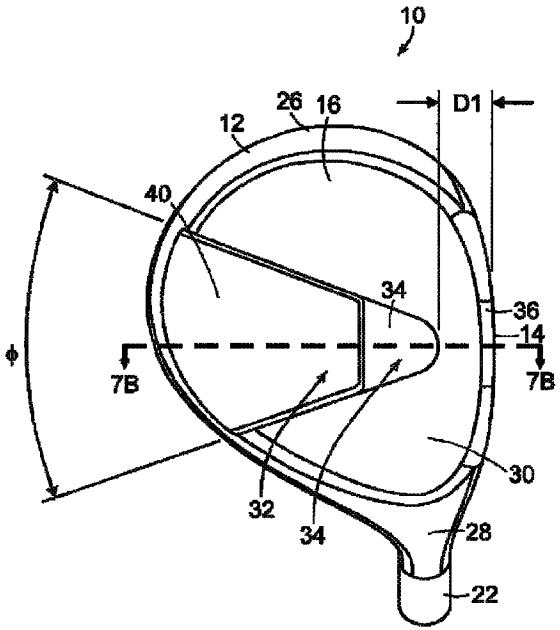
FIG. 7A is a bottom plan view of a club head with the inventive sole of FIG. 1.

FIGS. 7A-7B illustrate the sole 16 of the club head 10 and a cross-sectional view through line 7B-7B which illustrates the multi-relief surface 32 of the sole 16. The negative bounce portion 34 is spaced a distance D1 from the strike face, where D1 is preferably about 0.1 to 1.0 inch. More preferably, D1 is about 0.35 to 0.65 inch from the strike face 14 of the club head 10. The distance D1 may be different for different club heads as it may depend on the face progression and the loft of the club head. As illustrated, the negative bounce portion 34 comprises a surface having an angle $\alpha$ from a plane S running along the bottom of the sole 16 parallel to the z-axis of a coordinate system running through the club head. The negative bounce portion 34 comprises about a negative 0.5 to a negative 4.0 degree surface, such that the angle $\alpha$ is about negative 0.5 to 4.0 degrees from the plane S. Preferably, the negative bounce portion 34 comprises about a negative 2.0 degree surface. It will be appreciated that the negative bounce portion 34 may have a constant angle or may have an angle that varies toward the back of the sole. The negative bounce portion 34 may have locations with multiple radii.

As illustrated, the multi-relief surface 32 includes both the negative bounce portion 34 and the cutaway portion 40 and these form a triangular shape. The triangular shape forms an angle $\phi$, angle $\phi$ is preferably about 35 to 50 degrees, and more preferably about 38 to 44 degrees. The negative bounce portion 34 and cutaway portion 40 have a length L, length L is preferably about 1 to 5 inches, and more preferably about 2 to 4 inches.

Figure 8:
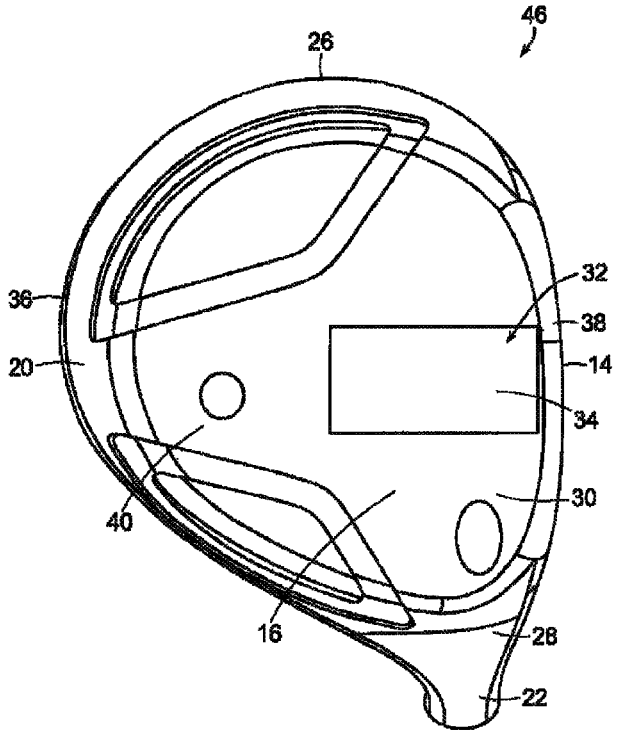
FIG. 8 is a bottom plan view of another alternative embodiment of a club head of the present invention.

FIG. 8 shows an alternative embodiment for the sole 16. The club head 46 features a multi-relief sole 32 as described above. The multi-relief sole features the negative bounce portion 34 and the cutaway portion 40. It will be appreciated that the negative bounce portion 34 and cutaway portion 40 may have any suitable shape.

In general, to increase the sweet spot, the center of gravity of the club head is moved toward the bottom and back of the club head. This permits an average golfer to launch the ball up in the air faster and hit the ball farther. In addition, the moment of inertia of the club head is increased to minimize the distance and accuracy penalties associated with off-center hits. In order to move the weight down and back without increasing the overall weight of the club head, material or mass is generally taken from one area of the club head and moved to another. Materials can be taken from the face of the club, creating a thin club face, the crown and/or sole and placed toward the back of the club.

Figure 9:
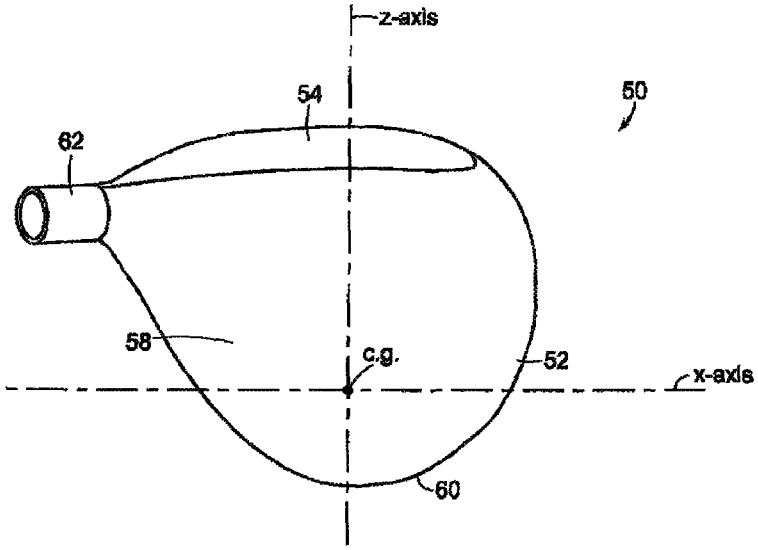
FIG. 9 is a top plan view of an alternative embodiment of a club head according to the present invention.

FIG. 9 illustrates a top of a club head 50 according to another embodiment of the present invention. Club head 50 includes a body 52 having a strike face 54, a sole 56 (see FIGS. 10A and 10B), a crown 58, a skirt 60 and a hosel 62. The body defines a hollow interior volume 64 (See FIGS. 10B and 12B). The face may be provided with grooves or score lines of varying design. The club head has a toe 66 and a heel 68.

FIG. 9 illustrates the center of gravity (c.g.) along the x-axis and z-axis. In order to improve playability of the club head 50 it is desired to be able to move the c.g. within the club head 50 to a more optimal position. Preferably, the club head 50 features a weight system 70 (see FIGS. 10A-10B and 12A-12B) to move the c.g. within the club head 50 to a more optimal position. Preferably, the c.g. is movable within a 6 mm distance along the z-axis in comparison to a club head without the weight system. More preferably, the c.g. is movable within a 4 mm distance along the z-axis. The c.g. may be movable within a 6 mm distance along the x-axis in comparison to a club head without the weight system, more preferably within a 2 mm distance, and still more preferably within a 0.5 mm distance. Additionally, the c.g. is moveable within a 6 mm distance along the y-axis in comparison to a club head without the weight system (See FIGS. 10A-10B and 12A-12B). Preferably the c.g. is moveable within a 2 mm distance along the y-axis.

The c.g. adjustability may not substantially affect the dynamic loft of the club head. For example, for a 3 mm front-back c.g. shift the dynamic loft changes about 0.4 degrees. When the c.g. is moved back, the backspin may increase, for example between 100 and 300 rpm per 3 mm of c.g. movement toward the rear of the club head.

Figure 10A:
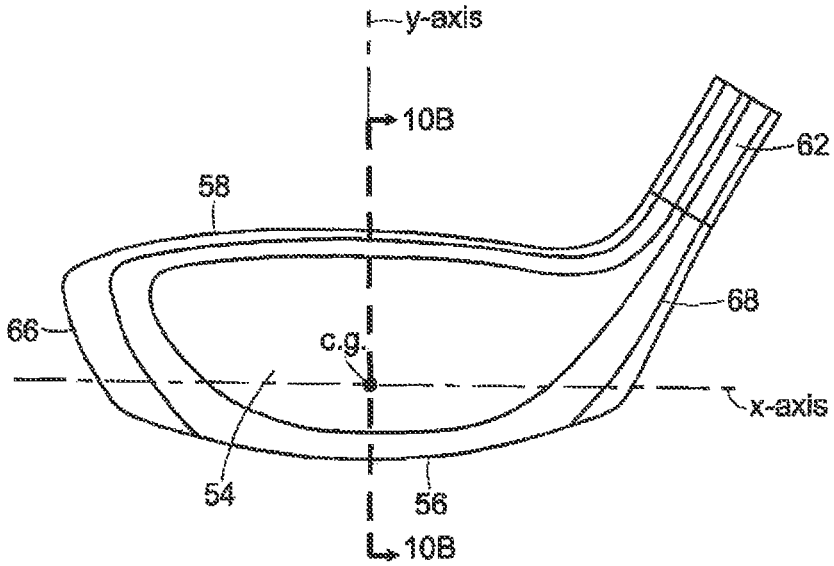
FIG. 10A is a front plan view of a club head according to an embodiment of the club head of FIG. 9.
Figure 10B:
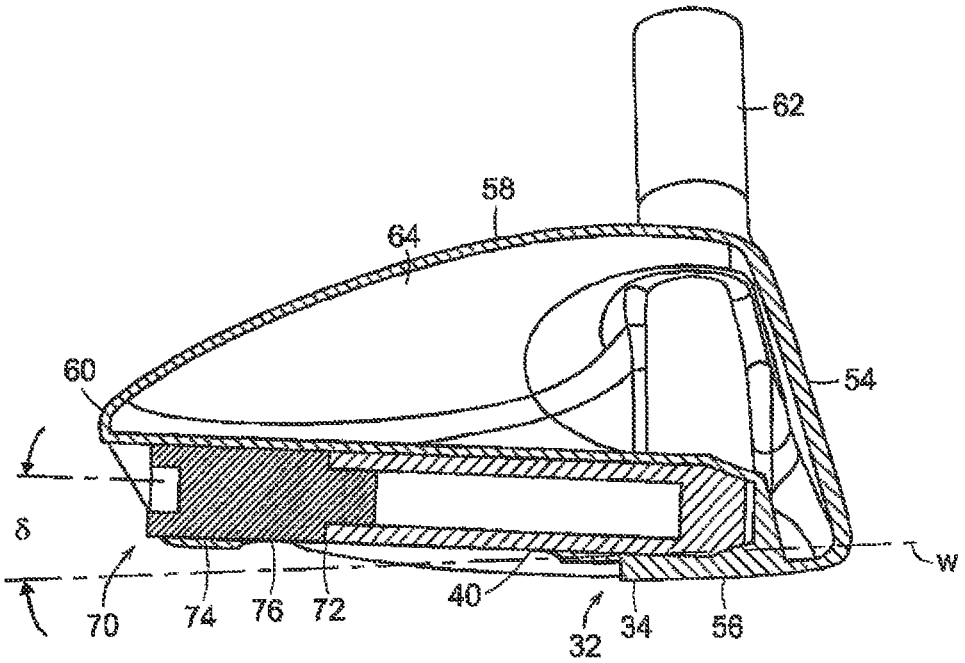
FIG. 10B is a cross-sectional view of the club head of FIG. 10A, taken along lines 10B-10B.

FIG. 10A illustrates the front face 54 of the club head showing the x-axis and the y-axis. FIG. 10B is a cross-sectional view taken along lines 10B-10B of FIG. 10A. FIG. 10B depicts the inside of the club head featuring a weight system 70 according to the invention, and the c.g. may be moved along the z axis and y axis.

Figure 11:
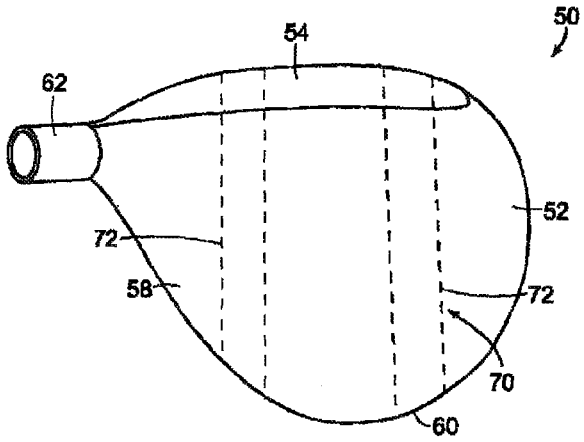
FIG. 11 is a top plan view of the club head according to an embodiment of FIG. 9.

FIG. 10B depicts the weight system 70 as a tube 72 placed within the club head 50 within a plane formed by the y-axis and z-axis to adjust the c.g. of the club head. As illustrated in FIG. 11, it will be appreciated that more than one tube 72 may be provided within the club head 50. As illustrated in FIG. 10B, the weight system 70 features a tube 72 with a weight 74 at one end 76 of the tube 72. As shown in FIG. 10B, the weight 74 is placed the back of the club head 50 to move the c.g. to a desired location for desirable ball flight. When the weight 74 is located at a back of the club head 50, a shot hit off the club head 50 has increased backspin and a higher launch angle resulting in a softer landing. In an alternative embodiment, it will be appreciated that the tube 72 may feature multiple inserts varying in weight for placement within the tube 72 to move the c.g. of the club head 50 to a desired location.

As illustrated, the tube 72 is preferably provided at an angle within the club head 50. The tube 72 is angled downward toward the face 54 of the club head 50, such that the tube 72 is provided within the plane formed by the z-axis and y-axis. The tube 72 may be angled by an angle $\delta$, where $\delta$ is at least 1 degree from the plane W formed by the z axis and x axis. Preferably, the tube is angled downward toward the face 54 by at least 3 degrees from the plane W formed by the z-axis and x-axis. More preferably, the tube 72 is angled downward toward the face of the club head 50 by about 3 to 7 degrees from the plane W formed by the z-axis and x-axis. It will be appreciated that although the tube 72 is described herein as being provided within a plane formed by the y-axis and z-axis, the tube 72 may be offset in either direction from that plane by any desired amount.

Figure 12A:
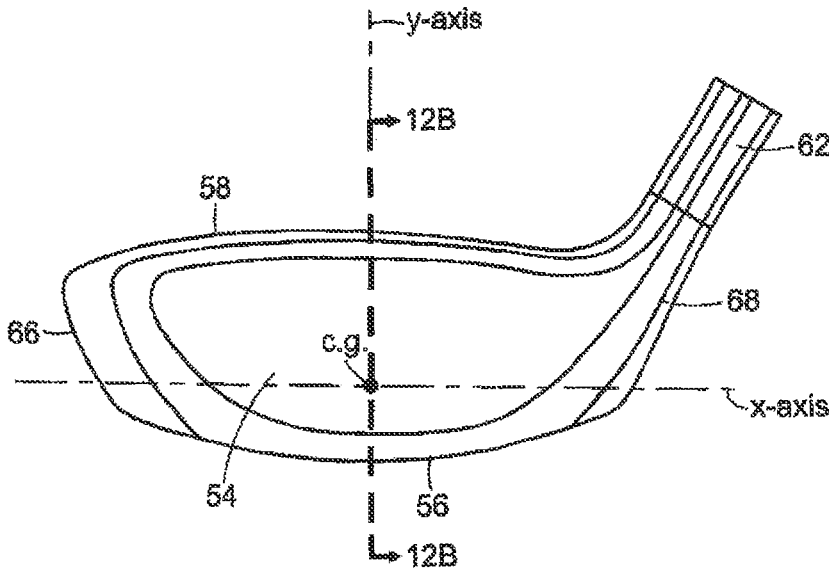
FIG. 12A is a front plan view of a club head according to an embodiment of the club head of FIG. 9.
Figure 12B:
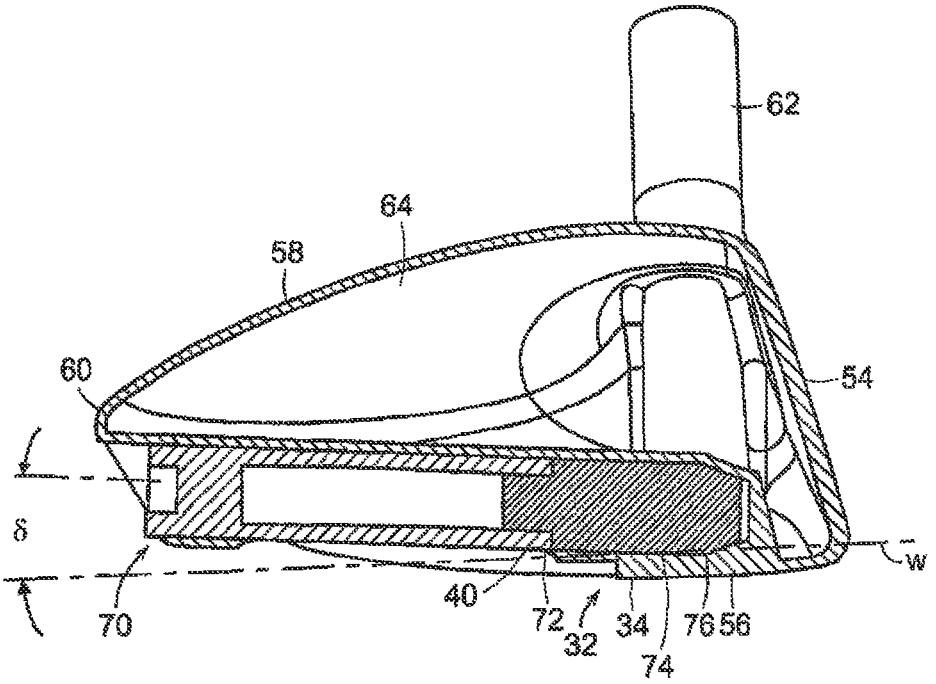
FIG. 12B is a cross-sectional view of the club head of FIG. 12A, taken along lines 12B-12B.

Now referring to FIG. 12A-12B, it will be appreciated that the tube 72 may be flipped within the club head 50, such that the weight 74 is provided at the other end 76 of the club head 50, closer to the face 54, to move the c.g to a different location for desirable ball flight. When the weight 74 is located at a front of the club head 50 a shot hit off the club head 50 has less backspin and a lower trajectory resulting in a shallower landing for increased distance. It will be appreciated that the tube 72 itself may be able to be inserted in the club head with the weight 74 in either direction, or that different tubes 72 may be selectable with the weight 74 at the desired end and then provided in the club head.

It will be appreciated that a club having the weight system 70, such as the tube 72 and weight 74, may also include the multi-relief surface 32 on the sole 56 as described above. For example, in FIGS. 10B and 12B the sole 56 may feature a multi-relief surface 32 with a negative bounce portion 34 and a cutaway portion 40 as described above. It will also be appreciated that the angle δ of the tube may be substantially parallel to the multi-relief surface 32.

Figure 13:
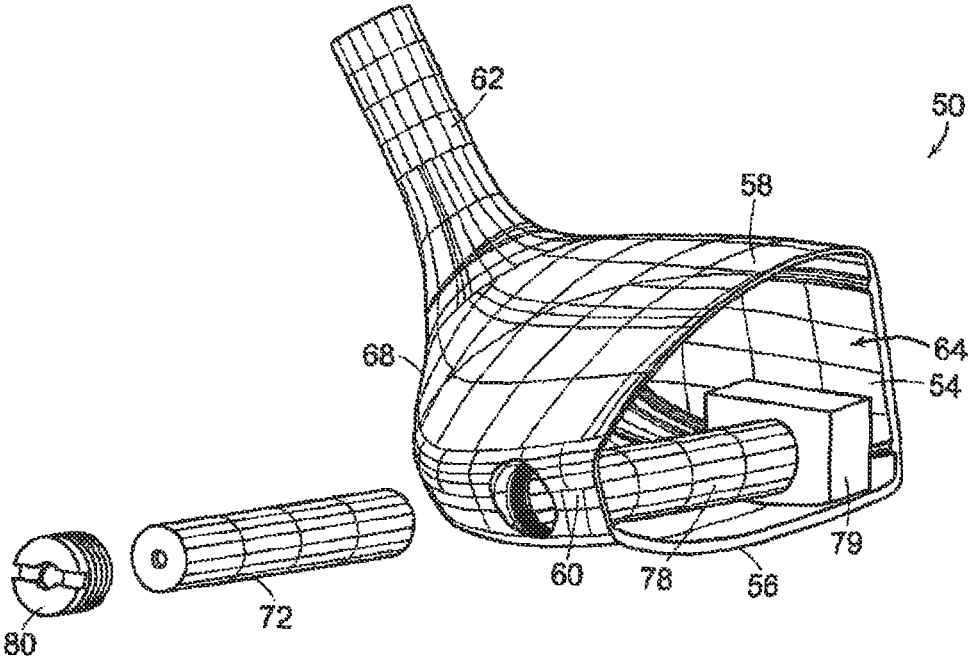
FIG. 13 is a back perspective cut-out view of an embodiment of a club head according to FIG. 9.
Figure 14:
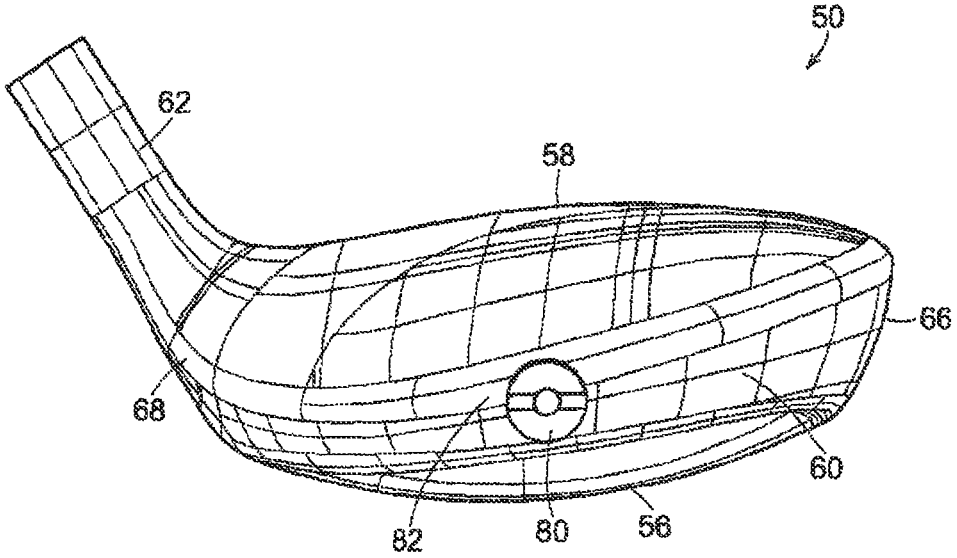
FIG. 14 is a back view of the club head of FIG. 13.

FIG. 13 illustrates how the tube 72 may be inserted into the club head 50. A sheath 78 extending from a block 79 in the club head 50 receives the tube 72 with the weight 74, and a fastener 80 locks the tube 72 in place within the club head 50. The tube 72 is fastened to the outside of the club head 50 substantially flush with an outer surface 82 of the club head, as illustrated in FIG. 14.

Figure 15:
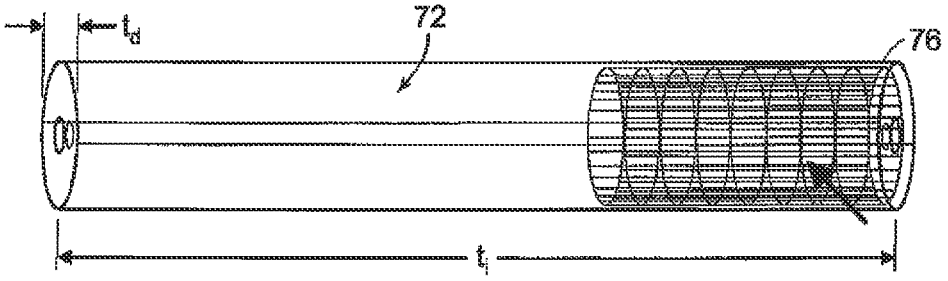
FIG. 15 is a perspective view of a weight tube according to the embodiment of the FIG. 13.

FIG. 15 illustrates the tube 72 according to the embodiment of FIG. 13. The weight 74 is provided at an end 76 of the tube 72. It will be appreciated that the tube 72 and weight 74 may be joined by threaded engagement, epoxy, mechanical lock or other joining method. The weight 74 may comprise tungsten or any other suitable material. The weight 74 has a mass of about 10 to 25 grams. The combined mass of the tube 72 and weight 74 is about 20 to 40 grams. Preferably, the tube 72 comprises aluminum, although any other suitable material may be used.

It is envisioned that the orientation of the tube 72 may be set during manufacture, may be modified by the user, or may be modifiable by the manufacturer or a designated fitting location. The tube 72 has a diameter $t_d$ of about 0.3 to 0.5 inch and a length $t_1$ of about 2 to 3 inches. It will be appreciated that more than one tube 72 could be provided in the club head 50 at any one time as illustrated in FIG. 11, or that multiple tubes 72 with a different mass may be provided to the user or fitting location.

Figure 16:
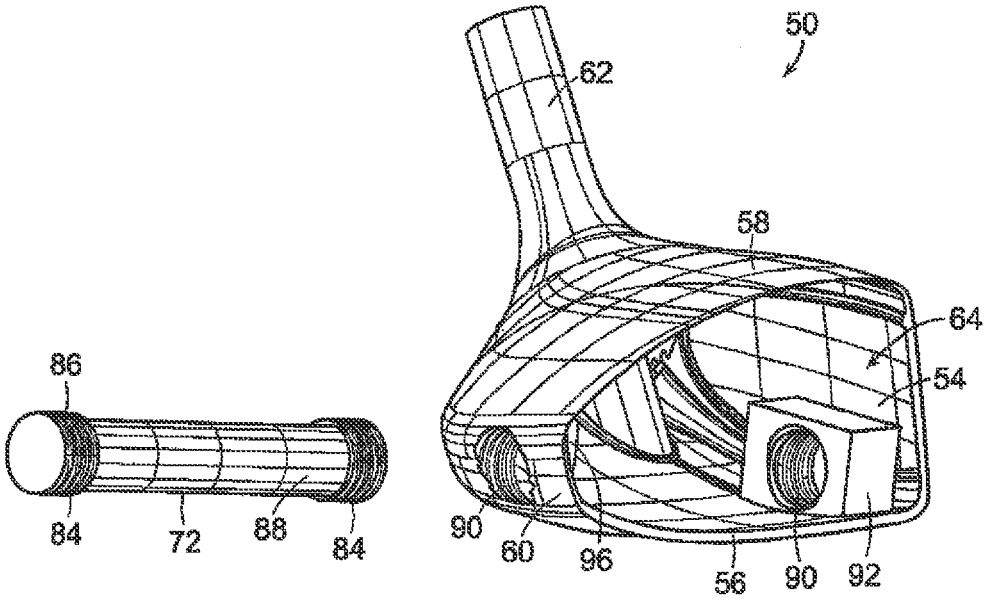
FIG. 16 is a back perspective cut-out view of another embodiment of a club head according to FIG. 9.

FIG. 16 illustrates an alternative embodiment for placement of the tube 72 within the club head 50. In this embodiment, the tube 72 has threads 84 on both ends 86 and 88 that interlock in threaded engagement to the mating threads 90 on a block 92 inside the club head adjacent the face 54 and threads 94 on a block 96 adjacent the skirt 60 of the club head 50. The tube 72 is fastened to the inside of the club head 50 adjacent the face 54. It is envisioned that the orientation of the tube 72 may be set during manufacture, may be modified by the user, or may be modifiable by the manufacturer or a designated fitting location.

Figure 17:
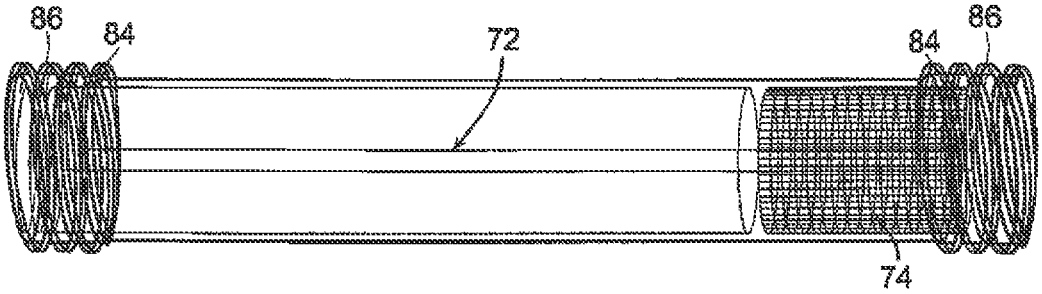
FIG. 17 is a perspective view of a weight tube according to the embodiment of the FIG. 17.

FIG. 17 illustrates the tube 72 of the embodiment of FIG. 16 showing the dual threaded ends 86 and 88 of the tube that may be inserted in either direction into the club head 50 and threadedly received adjacent the face 54. The tube 72 has a diameter $t_d$ and a length $t_1$ as described above and the weight 74 and tube 72 have a similar mass as described above. The exterior of the tube 72 would align substantially flush with the outer surface 82 of the club head 50.

Figure 18:
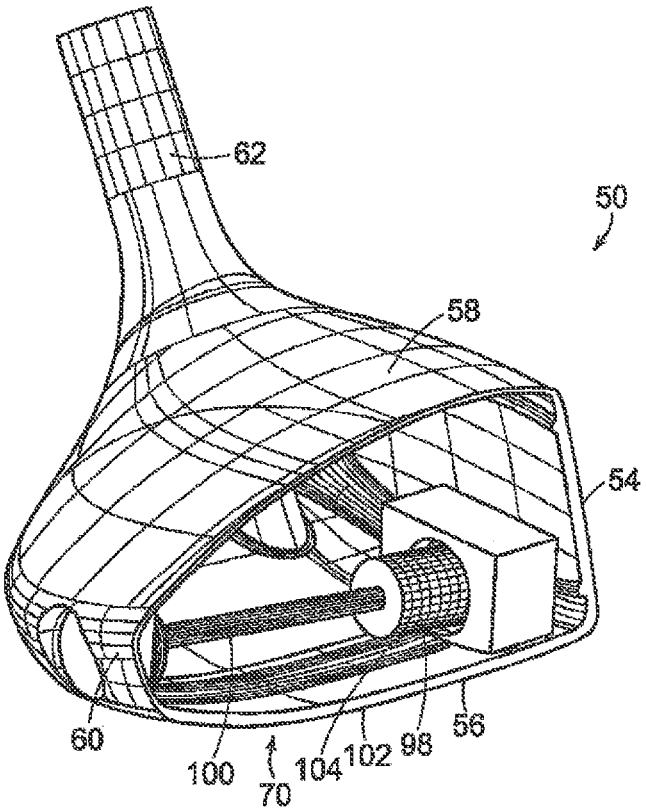
FIG. 18 is a back perspective cut-out view of another embodiment of a club head according to FIG. 9.

FIG. 18 shows an alternative embodiment for the weight system 70 where a weight 98 may be slid along a pipe 100 provided in the club head 50. The exterior surface 102 of the sole 56 of the club head 50 may feature a mechanism 104 to move the weight 98 along the pipe 100 to the desired location to move the c.g. for the desired ball flight as described above. Alternatively, the position of the weight 98 on the pipe 100 may be set during manufacture of the club head.

Figure 19:
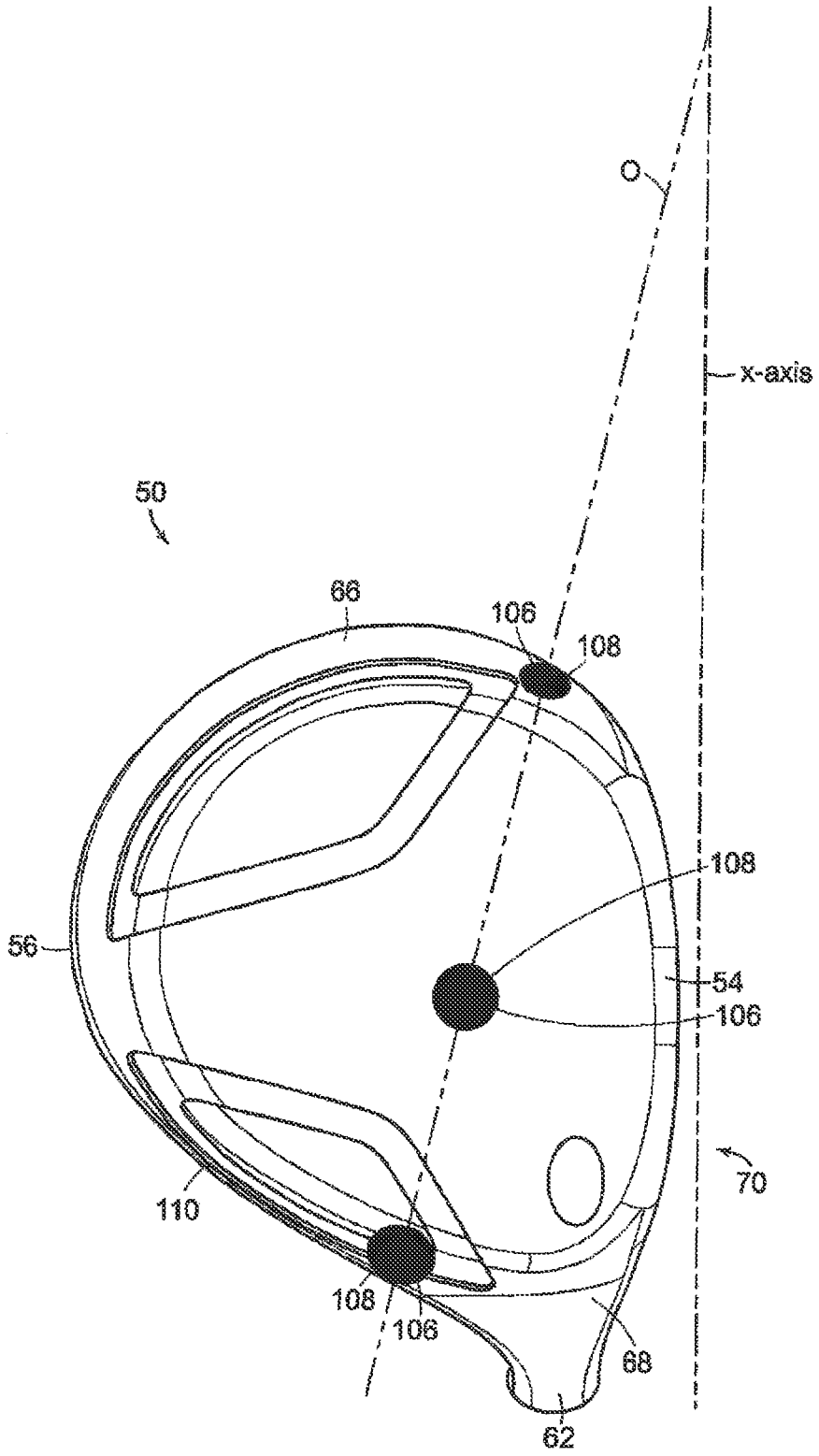
FIG. 19 is a bottom plan view of another embodiment of a club head according to FIG. 9.

FIG. 19 features another alternative embodiment for the weight system 70. This embodiment features two or more cavities 106 in the sole 56 of the club head 50 for receiving inserts 108. The cavities 106 may be placed in any desired location on the club head 50. As illustrated, the three cavities 106 are provided along an axis O offset from the x-axis. The cavities 106 may be aligned parallel to the x-axis or may be offset in either direction. The cavities 106 may be provided on an axis O offset from the x-axis by 0 to 90 degrees in either direction. The back portion 110 of the club head may feature deeper cavities 106 to mimic the angle of the tube 72 described above relative to the plane formed by the z-axis and x-axis. The inserts 108 may have different mass and may be placed in the different cavities 106 to move the c.g. to a desired location. The inserts 108 may be movable by the user, or they may be set at the time of manufacture or modifiable in a fitting environment.

Figure 20:
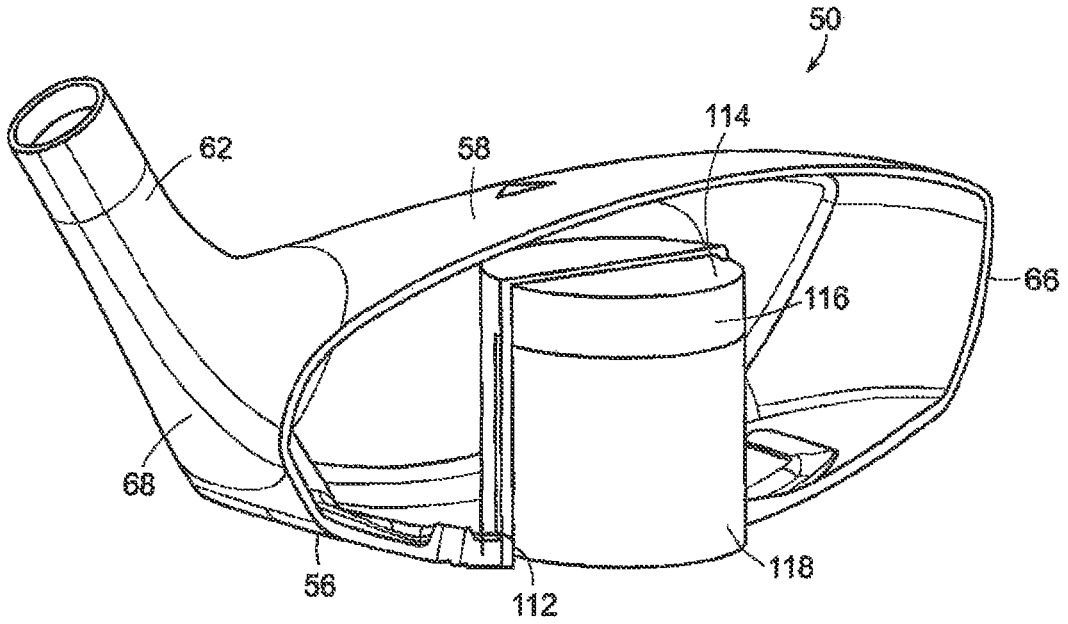
FIG. 20 is a front perspective cut-out view of another embodiment of a club head according to FIG. 9.

FIG. 20 illustrates yet another alternative embodiment of the weighting system 70 for moving the center of gravity along the y-axis. As illustrated, the club head 50 features a vertical cavity 112 extending from the sole 56 into the hollow volume 64 of the club head. The cavity 112 may be placed in any desired location in the sole 56, for example centered along the width of the face 54 and located more toward the back of the club head 50, as illustrated. A weight 114 is made to fit within the cavity 112, such that it mates securely within the cavity 112. It will be appreciated that the weight 114 may be secured in the cavity in any suitable manner, including threaded engagement, epoxy, mechanical lock, or other joining method. As illustrated, the cavity 112 is cylindrical and the weight 114 is a corresponding cylindrical plug, although it will be appreciated that the weight 114 and mating cavity 112 may be any suitable shape and size. The weight 114 features a heavy end 116 and a lighter end 118. The heavy or lighter end 116 and 118 may be placed closer to the sole 56 to move the c.g. to the desired location along the y-axis. It is envisioned that the orientation of the orientation of the weight 114 may be set during manufacture, may be modified by the user, or may be modifiable by the manufacturer or a designated fitting location. This embodiment may assist in isolating just one attribute, moving the c.g. along the y-axis, thereby making club fitting more straight forward.

Figure 21:
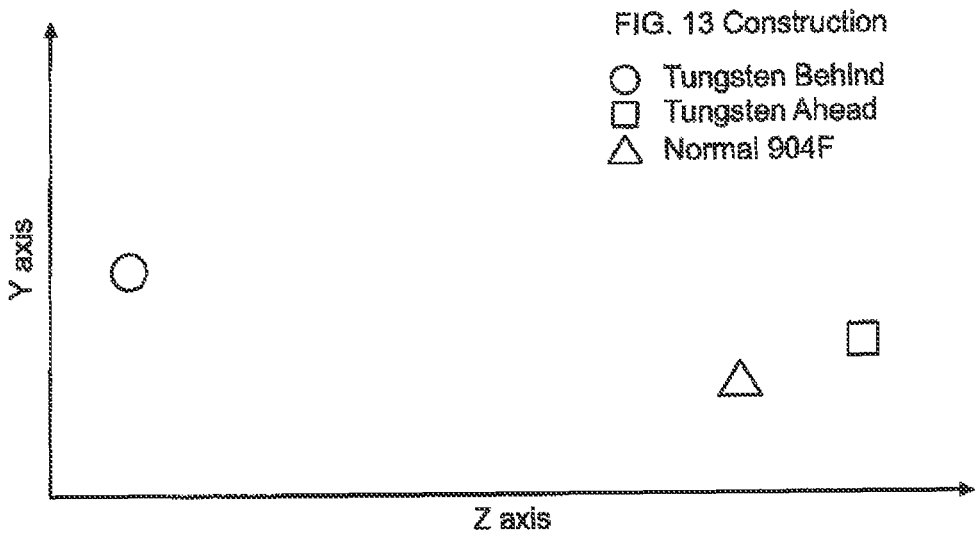
FIG. 21 is a graph depicting the movement of the center of gravity along the y-axis and z-axis according to the embodiment of FIG. 13.

As illustrated in FIG. 21, the movement of the c.g. is illustrated based on the construction of FIG. 13. It illustrates the movement of the c.g. along the y-axis and z-axis between a normal Titleist 904F fairway wood without a weight system, a club head 50 with the weight system 70 of FIG. 13 having the weight 74 in the back of the club head 50, and a club head 50 with the weight system 70 of FIG. 13 having the weight 74 in the front of the club head 50. FIG. 21 illustrates the relative position of the c.g. along the y-axis and z-axis for these various club heads.

Figure 22:
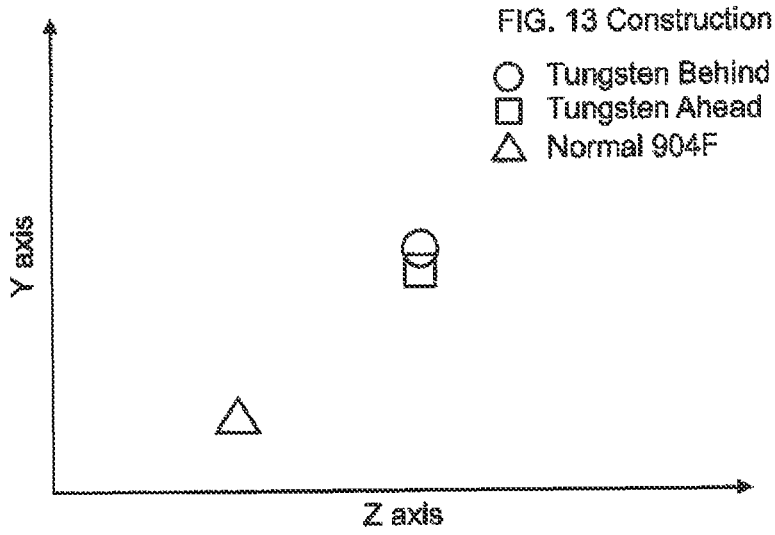
FIG. 22 is a graph depicting the movement of the center of gravity along the y-axis and x-axis according to the embodiment of FIG. 13.

As illustrated in FIG. 22, the movement of the c.g. is illustrated based on the construction of FIG. 13. It illustrates the movement of the c.g. along the y-axis and x-axis between a normal Titleist 904F fairway wood without a weight system, a club head 50 with the weight system 70 of FIG. 13 having the weight 74 in the back of the club head 50, and a club head 50 with the weight system 70 of FIG. 13 having the weight 74 in the front of the club head 50. FIG. 22 illustrates the relative position of the c.g. along the y-axis and x-axis for these various club heads.

Figure 23:
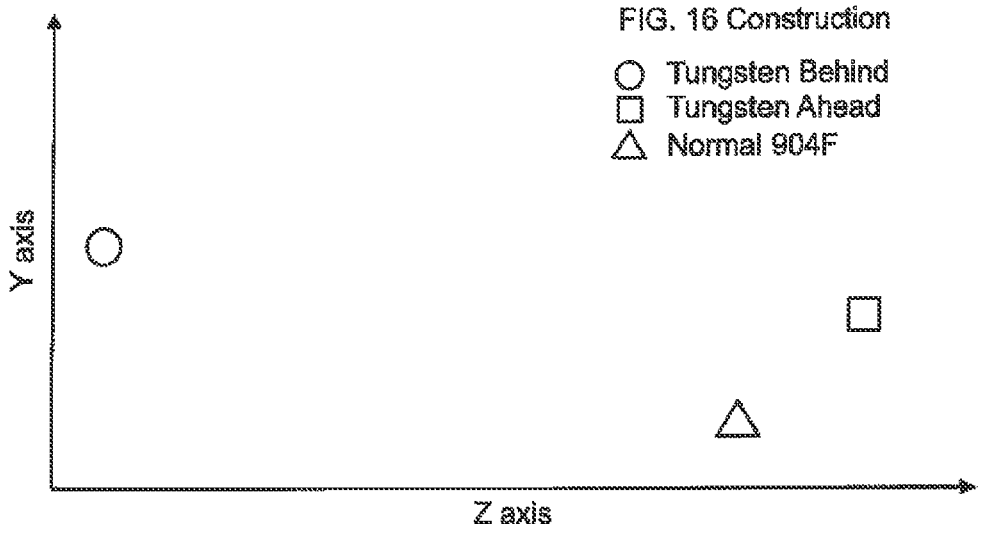
FIG. 23 is a graph depicting the movement of the center of gravity along the y-axis and z-axis according to the embodiment of FIG. 16.

As illustrated in FIG. 23, the movement of the c.g. is illustrated based on the construction of FIG. 16. It illustrates the movement of the c.g. along the y-axis and z-axis between a normal Titleist 904F fairway wood without a weight system, a club head 50 with the weight system 70 of FIG. 16 having the weight 74 in the back of the club head 50, and a club head 74 with the weight system 70 of FIG. 16 having the weight 74 in the front of the club head 50. FIG. 23 illustrates the relative position of the c.g. along the y-axis and z-axis for these various club heads.

Figure 24:
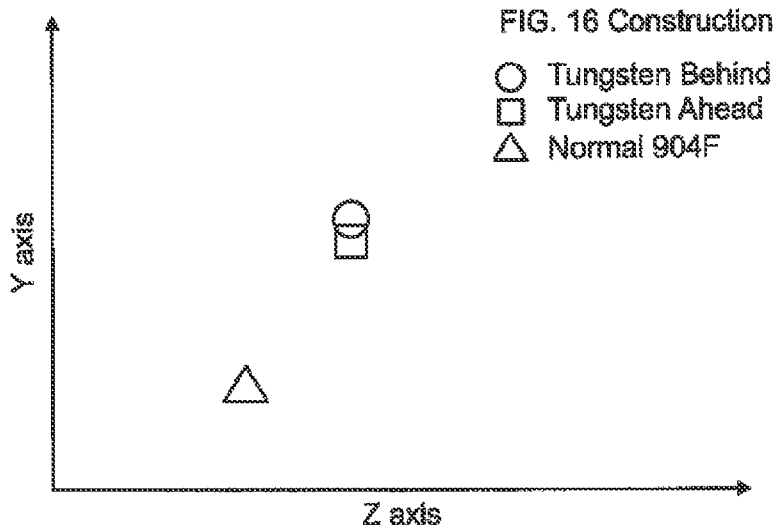
FIG. 24 is a graph depicting the movement of the center of gravity along the y-axis and x-axis according to the embodiment of FIG. 16.

As illustrated in FIG. 24, the movement of the c.g. is illustrated based on the construction of FIG. 16. It illustrates the movement of the c.g. along the y-axis and x-axis between a normal Titleist 904F fairway wood without a weight system, a club head 50 with the weight system 70 of FIG. 16 having the weight 74 in the back of the club head 50, and a club head 50 with the weight system 70 of FIG. 16 having the weight 74 in the front of the club head 50. FIG. 24 illustrates the relative position of the c.g. along the y-axis and x-axis for these various club heads. The locations of the c.g. shown in FIGS. 21-24 were calculated using a commercially available CAD (computer aided design) system.

While various descriptions of the present invention are described above, it should be understood that the various features of each embodiment could be used alone or in any combination thereof. Therefore, this invention is not to be limited to only the specifically preferred embodiments depicted herein. For example, the multi-relief surface sole may be combined in one club head with the weight system to move the c.g. of the club head. Further, it should be understood that variations and modifications within the spirit and scope of the invention might occur to those skilled in the art to which the invention pertains. Accordingly, all expedient modifications readily attainable by one versed in the art from the disclosure set forth herein that are within the scope and spirit of the present invention are to be included as further embodiments of the present invention. The scope of the present invention is accordingly defined as set forth in the appended claims.

We claim:

1. A golf club head, the club head comprising:

a body having a face, a sole, a crown and a skirt joining the face, sole and crown, the body having a heel end and a toe end, wherein the sole of the golf club head further comprises a multi-relief surface, wherein the multi-relief surface further comprises;

a leading edge at a frontal portion of the multi-relief surface, adjacent to the face;

a negative bounce portion, located rearward of the leading edge, adjacent to and substantially aligned with a hosel portion of said golf club head; and consisting only one of a cutaway portion at least partially adjacent to the rear of the negative bounce portion;

wherein the cutaway portion has a different bounce angle than the negative bounce portion and wherein the cutaway portion forms a depression on the sole of the golf club head, and wherein there is a step in depth at a boundary between a negative bounce portion and the cutaway portion.

2. The golf club head of claim 1, wherein at least a portion of the cutaway portion extends from the negative bounce portion to a trailing edge of the golf club head.

3. The golf club head of claim 2, wherein at least a portion of the negative bounce portion has a bounce angle of between about negative 0.5 degrees to a negative 4.0 degrees.

4. The golf club head of claim 3, wherein at least a portion of the negative bounce portion has a bounce angle of about negative 2.0 degrees.

5. The golf club head of claim 4, wherein a depth of the cutaway portion is constant.

6. The golf club head of claim 4, wherein a depth of the cutaway portion is not constant.

7. The golf club head of claim 4, wherein the negative bounce portion has a constant bounce angle.

8. The golf club head of claim 4, wherein the negative bounce portion has a variable bounce angle.

9. A golf club head, the club head comprising:

a body having a face, a sole, a crown and a skirt joining the face, sole and crown, the body having a heel end and a toe end, wherein the body has an address position further comprises;

a center sole portion located rearward of the face, wherein said center sole portion further comprises a negative bounce portion adjacent to and substantially aligned with a hosel portion of said golf club head, and consisting only one of a cutaway portion at least partially adjacent to the rear of the center sole portion of the sole, and a weighting system further comprising a tube and a weight located within said cutaway portion, wherein the weighting system is orientated along a plane formed by a y-axis and a z-axis in a forward and aft direction wherein at least a portion of the cutaway portion extends from the center sole portion to a trailing edge of the golf club head.

10. The golf club head of claim 9, wherein the weighting system is angled by an angle δ of at least 1 degree from the plane W formed by the z-axis and a x-axis.

11. The golf club head of claim 10, wherein the weighting system is angled by an angle δ of at least 3 degrees from the plane W formed by the z-axis and a x-axis.

12. The golf club head of claim 11, wherein the weighting system is angled by an angle δ of between 3 to 7 degrees from the plane W formed by the z-axis and a x-axis.

13. The golf club head of claim 9, wherein the weighting system could be flipped such that the tube is able to be inserted into the club head with the weight in two or more directions.

14. The golf club head of claim 9, wherein a center of gravity of the golf club head is able to be moved along the z-axis and the y-axis as an orientation of the weighting system is reversed.

* * * * *